United States Patent [19]

Melling et al.

[11] Patent Number: 4,943,093

[45] Date of Patent: Jul. 24, 1990

[54] SECURITY PAPER FOR BANK NOTES AND THE LIKE

[75] Inventors: Raymond J. Melling, Overton; Malcolm R. M. Knight, Basingstoke, both of United Kingdom

[73] Assignee: Portals Limited, Basingstoke, United Kingdom

[21] Appl. No.: 270,066

[22] Filed: Nov. 14, 1988

[30] Foreign Application Priority Data

Dec. 4, 1987 [GB] United Kingdom ..... 8728390
Aug. 31, 1988 [GB] United Kingdom ..... 8820535

[51] Int. Cl.[5] ..... B42D 15/00; G09F 19/00; G09F 19/12; G09F 19/14

[52] U.S. Cl. ..... 283/83; 283/70; 283/91; 283/901

[58] Field of Search ..... 283/7, 9 R, 58, 70, 283/89, 90, 91, 902, 83; 162/110; 350/407

[56] References Cited

U.S. PATENT DOCUMENTS

| | | | |
|---|---|---|---|
| 2,330,718 | 9/1943 | Kallmann | 283/89 |
| 3,391,479 | 7/1968 | Buzzell et al. | 283/90 |
| 3,880,706 | 4/1975 | Williams . | |
| 4,157,784 | 6/1979 | Grottrup et al. | 283/89 |
| 4,186,943 | 2/1980 | Lee | 283/70 |
| 4,437,935 | 3/1984 | Crane, Jr. | 283/91 |
| 4,455,039 | 6/1984 | Weitzen et al. | 283/901 |
| 4,534,398 | 8/1985 | Crane | 283/91 |
| 4,552,617 | 11/1985 | Crane | 162/110 |
| 4,652,015 | 3/1987 | Crane . | |

FOREIGN PATENT DOCUMENTS

| | | |
|---|---|---|
| 0059056 | 5/1985 | European Pat. Off. . |
| 0229645 | 1/1987 | European Pat. Off. . |
| 2205425 | 2/1972 | Fed. Rep. of Germany . |
| 19963 | of 1910 | United Kingdom . |
| 1411477 | 2/1973 | United Kingdom . |
| 1552853 | 9/1976 | United Kingdom . |
| 1580951 | 3/1977 | United Kingdom . |
| 1486079 | 9/1977 | United Kingdom . |
| 1604463 | 5/1978 | United Kingdom . |
| 2119312 | 11/1983 | United Kingdom . |

*Primary Examiner*—Douglas D. Watts
*Assistant Examiner*—Paul M. Heyrana
*Attorney, Agent, or Firm*—Bacon & Thomas

[57] ABSTRACT

Security papers according to the invention comprise opposed surfaces for the provision of printing to identify a document formed from the paper, and positioned at least partially between the two surfaces of the paper as a public security feature a security device of not more than 5 mm width, which device comprises a flexible, water-impermeable substrate with a layer of metal on one or both sides of the substrate, there being present on one side of the device a continuous metal path along its length, wherein said device has metal-free portions of between 10% and 50% of the area of the device, said metal-free portions along the length of the device providing a repeating pattern, design, indicia or the like with at least some of the metal-free portions across the tranverse direction of the device being wholly surrounded by metal. The metal-free portions may provide characters of a language, such as letters of the English alphabet. The security device may be a strip or thread and this may be positioned in a window, or in an aperture where two windows are impartial or complete register.

28 Claims, 5 Drawing Sheets

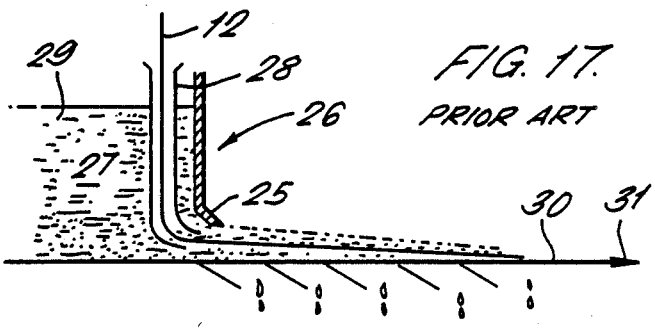
FIG. 17.
PRIOR ART
FIG. 18.
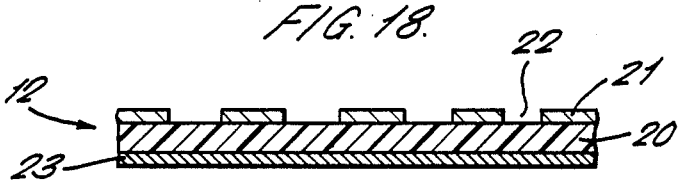
FIG. 19.
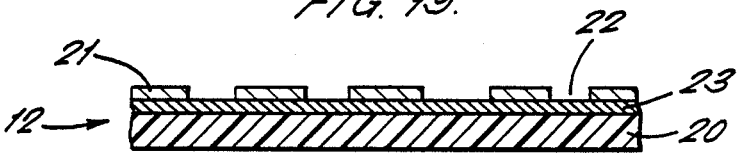
FIG. 20.
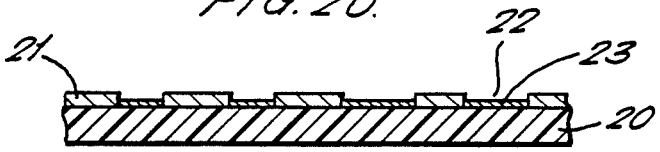

SECURITY PAPER FOR BANK NOTES AND THE LIKE

BACKGROUND OF THE INVENTION

The invention is concerned with security paper for bank notes and the like, and to processes for producing such paper.

It is widely known to use in bank notes security strips or threads which are made from a transparent film provided with continuous reflective metal layer, vacuum deposited aluminium on polyester being the commonest example. Bank notes made from such paper have been in general circulation in many countries for many years. The principal feature of such threads is that when they are embedded in security paper, and the paper is subsequently printed to provide the security document, which includes bank notes, the thread cannot be readily discerned in reflected light but is immediately apparent as the security thread provides a dark image when the document is viewed in transmitted light. Such well-used security threads are simple in concept, but the device is extremely effective since the optically variable effect which is provided cannot be accurately simulated, for example by printing a line on the paper. The continued wide-spread use of this security feature for many years after its first introduction is a strong indication of its efficacy.

It is known that metallised films can be produced such that no metal is present in controlled and clearly defined areas. Such partly metallised film can be made in a number of ways. One way is to selectively demetallise regions using a resist and etch technique such as is described in U.S. Pat. No. 4652015. Other techniques are known for achieving similar effects; for example it is possible to vacuum deposit aluminium through a mask or aluminium can be selectively removed from a composite strip of a plastic support and aluminium using an excimer laser.

It is important to provide even better security paper in order to enhance the public perception/recognition of a security thread for the purpose of authentication by the public. This may be achieved by incorporating within the security thread a pattern which is readily recognisable by the public while retaining the widely accepted optically variable effect which is provided by the continuously metallised strip. Many currencies of the world incorporate a microprinted thread incorporating fine printed characters but these are generally too small to be recognised in a printed document with the unaided eye. If the printed characters are made larger, they are very obvious when viewed in reflected light and readily simulated by a counterfeiter. The present invention makes use of a pattern or characters sufficiently large so as to be readily perceived by the naked eye and formed from a partially metallised strip such that the strong optically variable effect of a continuously metallised strip is essentially retained.

SUMMARY OF THE INVENTION

According to the present invention there is provided security paper comprising opposed surfaces for the provision of printing to identify a document formed from the paper, and positioned at least partially between the two surfaces of the paper as a public security feature a security device of not more than 5 mm width, which device comprises a flexible, water-impermeable substrate with a layer of metal on one or both sides of the substrate, there being present on one side of the device a continous metal path along its length, wherein said device has metal-free portions of between 10% and 50% of the area of the device, said metal-free portions along the length of the device providing a repeating pattern, design, indicia or the like with at least some of the metal-free portions across the transverse direction of the device being wholly surrounded by metal. It will be understood that a metal-free area of 10% to 50% requires a metal cover of from 90% to 50%, and the metal cover is preferably on one side of the security device, but may be present on each side with some or no overlap. The security device may be a strip or thread having a width of 0.5 to 5 mm, and preferably has a width of 1 to 3 mm, e.g. about 1.6 mm.

Preferably the metal-free portion provides characters of a language, such as letters of the English alphabet; alternatively a wide variety of patterns or designs may be employed provided always that the strip or thread has at least one continuous metal path. The continuous metal path may be at one or both edges of the strip or thread, or it may be positioned intermediate the edges or it may vary along the length of strip from the edge to intermediate locations. The strip or thread may have parallel sides or one or both sides may have a regular or irregular non-linear configuration. The strip may be a plastics substrate with a partial covering of metal on one side thereof. Further, though not preferred, the strip or thread may have metal on both sides of a plastics substrate, and the non-metallised areas may overlap to provide an appropriately sized metal-free area.

It is preferred that the metal coverage is from 55% or 60% to 90%, and more preferably from 60% to 85% of the area of a strip or thread. In certain desirable embodiments of this invention a strip or thread is positioned within a watermark or the strip or thread is exposed by means of being placed within a window or an aperture of the paper where no or virtually no paper fibres are present on the strip.

In one embodiment of the invention, there is present on either or both sides of the security device a dye or a fluorescent material, which may be the same or different when the dye or fluorescent material is present on both sides of the strip or thread. It is to be understood that the term "dye" extends to colouring materials generally and includes pigments which can colour transmitted or reflected light. Also, the term "fluorescent material" extends to other materials which, when excited by suitable radiation emit characteristic radiation; for example the term includes phosphorescent materials and other materials which emit characteristic radiation when excited by radiation other than UV light. In a further embodiment of the invention the strip or thread comprises a plastics substrate with the metal on one side thereof, and a dye or fluorescent material is present in the plastics substrate or on the surface of said substrate. Also, the strip or thread may comprise a plastics substrate with the metal on one side thereof, and a dye or fluorescent material present in a coating on the surface of the metal. A dye or fluorescent material does not need to be present uniformly on one side of the security device, although a uniform layer is preferred. Furthermore, the strip or thread may comprise a plastics substrate with the metal on one side thereof and a dichroic layer present on at least one side of the device.

It is an important feature of the present invention that a counterfeiter is not able to simulate the effect of the continuously metallised portion or portions of a thread or strip as used in this invention by a simple drawn or printed line. For printing to be used to simulate a security paper according to the present invention, skillful printing is needed, but no printing can adequately simulate the contrast which is provided when the document produced using this invention is examined in transmitted and reflected lights when a marked contrast is obtained with a genuine document.

The security paper described in U.S. Pat. No. 4652015 is an attempt to achieve at least some of the benefits which are provided by the present invention. However, this present invention is far better suited to defeating the aims of counterfeiters and to providing the public with a readily verified security document, since the paper of this invention retains the widely recognised and very strong optically variable effect of a continuous metallised film by virtue of the fact that the major portion of the area of the strip or thread is metallised and there is continuity of metal along the length of the thread. A bank note or the like which is produced according to the aforementioned U.S. Patent Specification would be vulnerable to simulation by a printing technique using, for example, opaque white or cream inks on one surface of the paper; such a simulation may well be imperfect but experience has shown that it could be more than adequate to deceive many of the public. The optically variable effect of the metal characters used in the threads of U.S. Pat. No. 4,652,015 would not be accurately simulated but since the characters occupy only a minority of the thread area, any deficiencies in simulation may be easily overlooked. Furthermore it will be understood that the continuity of metal along the thread in this invention greatly enhances the ability to authenticate a bank note or other security document on a used-note sorting machine.

The invention also includes a process for making security paper as described above wherein a preformed security device is incorporated into paper during a continuous papermaking process to produce paper from which a plurality of substantially identical pieces of paper can be obtained which, when printed, form substantially identical security documents, such as bank notes. The continuous papermaking process may employ a Fourdrinier papermaking machine or a cylinder mould papermaking machine. The process may use a cylinder mould papermaking machine substantially as described in EP 0 059 056 to produce paper having windows in each of which there is present a portion of the security device. In a further process for making security paper the security device is positioned continuously between two webs of paper which are laminated together to produce the security paper.

It will be understood that the use of legends, characters, geometric patterns and the like greatly enhance the security of the thread when used in a windowed or apertured form. Windows may be provided by means known in the art other than those disclosed in our specification EPO 059 056. An alternative technique is to embed the strip or thread between two layers of fibre formed separately on a paper machine and subsequently brought together to form a single sheet whereby at least one of the plies contains a sequence of holes formed by a watermark or other process such that these holes (which contain no, or virtually no fibre) are at least partially located over the strip or thread thus exposing it. If the holes are found in one layer of fibre only, the security strip or thread will be exposed, or windowed, on one surface only of the final sheet. If the holes are present in both fibre layers but in different locations, the strip or thread will be exposed, or windowed, on both sides of the final sheet in different locations. If the holes are present in both fibre layers such that they are at least partially in register with each other and the strip or thread, then the strip or thread will be simultaneously exposed on both sides of the sheet to form an aperture.

One of the most important benefits of using partially metallised threads where some of the thread is exposed is in the prevention of counterfeiting where counterfeits are produced using a colour photocopier or scanner. This is more clearly explained in example 8.

Bank notes and other security documents produced from security paper according to this invention incorporate a security thread which is virtually undetectable in reflected light but which, when the paper is viewed by transmitted light without the aid of a lens or other viewing accessory, exhibits as strong highlights the pattern, design or indicia against the metal background which is much darker than the paper adjacent to the thread; also the highlighted areas which provide the pattern, design, indicia or the like may be brighter than the paper adjacent to the thread, for example where a relatively wide strip is incorporated into paper during fibre deposition.

When a dye is used in a layer on one side of the security strip or thread or one of these agents is incorporated in a plastics substrate for the metal, then the highlight areas will be coloured when illuminated with transmitted light and the colour can be significantly different from that of the paper adjacent the strip or thread. Similar effects can be achieved when the additional layer comprises a fluorescent material and illumination is effected with transmitted UV or IR light or other stimulating radiation; a further check on authenticity can be achieved in an appropriate security paper according to this invention by viewing in transmitted white light and comparing the image with that obtained by viewing with transmitted stimulating radiation.

It is to be understood that a security document made from security paper in accordance with this invention may be provided with two or more of the security strips described herein, and the security strips may be the same or different.

In one preferred form of the invention the non-metallised areas, that is the pattern, design, indicia, characters or the like are individually wholly surrounded by metal, the metal being present along the edges of the strip or thread. Furthermore, a strip or thread is constituted by a clear plastics film which is partially metallised on one side only and the continuous metal layer extends inter alia along the two edges of the plastic strip or thread parallel to the longitudinal axis thereof.

It is to be understood that the strip or thread may be of uniform width or may vary in width as is the case with certain known security threads. For threads of uniform width, then preferably the thread width may range from 0.5 mm to 2.0 mm, with character or indicia heights (i.e. the dimension across the width of the thread) in the range 0.3 mm to 1.5 mm. However, wider strips or threads may be used depending upon the procedure used to incorporate a strip or thread into the security paper. The strips or threads may be formed from transparent colourless plastic film with partial demetallisation providing the pattern, design, indicia or the like, and this film will then be slit to provide strips or threads of appropriate width, such as 1.2 mm.

Further variable visible effects can be obtained in accordance with this invention when one or both sides of the partially metallised strip or thread is provided, prior to its insertion into paper, with a uniform coating of a dichroic film; the colour perception of the metallised and highlight regions will then change with the viewing angle and/or according to the direction of illumination. The visual effects with a dichroic strip or thread are enhanced when the dichroic material is situated under a window formed in the paper such that the dichroic coating of the strip or thread is exposed.

A bank note or other security document produced from security paper according to this invention contains a strip or thread which provides an electrically conductive path extending along the length or width of the paper; such strip or thread may therefore be detected using conventional metal thread detection equipment on, for example, a used-note sorting machine. This property of the threads or strips according to this invention being detectable with conventional metal thread detection equipment is a valuable property which is not present in the case of bank notes or other security documents produced according to U.S. Pat. No. 4,652,015. Furthermore, by provision of a suitable detector, the distribution of metal within the strip or thread may be determined by electrical, optical or other means and compared to a reference pattern to provide a further technique for the authentication of a genuine document containing the strip or thread.

Additionally, where the metal and/or highlight areas are coloured or provided with a fluorescent coating according to one of the techniques already described, then by provision of a suitable illumination and detection system the coloured metal and/or highlight areas may be compared to a reference pattern as a further technique for authentication of a genuine document containing the strip or thread.

BRIEF DESCRIPTION OF THE DRAWINGS

FIGS. 15, 16, 18, 19 and 20 are enlarged portions of alternative cross sections of a security document according to the invention; and FIG. 17 is a side view in partial section of a Fourdrenier paper making machine of the prior art having a funnel tube for introducing a strip to the paper fibers.

DESCRIPTION OF THE PREFERRED EMBODIMENTS

Figure 1:
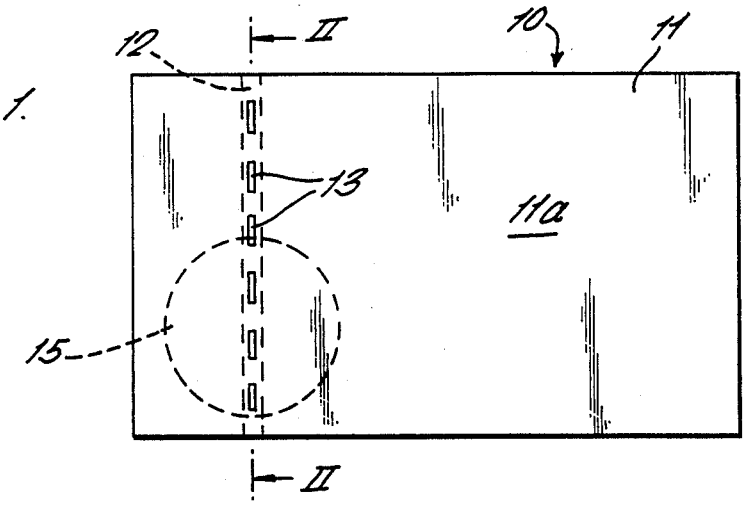
FIG. 1 is a plan view of a security document made from security paper according to the invention.
Figure 2:
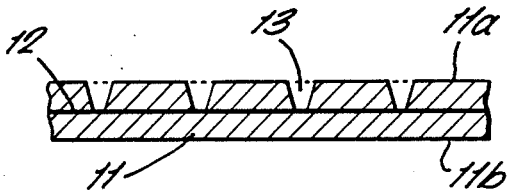
FIG. 2 is an enlarged portion of a cross section of the security document of FIG. 1 on line II—II.

The invention will be illustrated by the following description of preferred embodiments with reference to the drawings. With reference to FIGS. 1 and 2, a security document 10, such as a bank note, comprises security paper 11 and a security device 12 such as a security thread. The security paper 11 has two surfaces 11*a*, 11*b* which are used for printing to form the security document 10 as shown in FIG. 1. The security device is positioned in the security paper 1 between the surfaces 11*a* and 11*b* thereof as shown in FIG. 2.

Figure 3A:
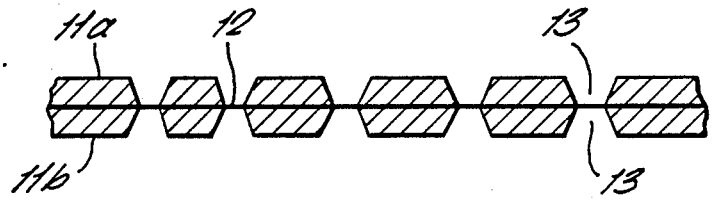
FIGS. 3*a*, 3*b* and 3*c* are enlarged portions of alternative cross sections of a security document according to the invention.
Figure 3B:
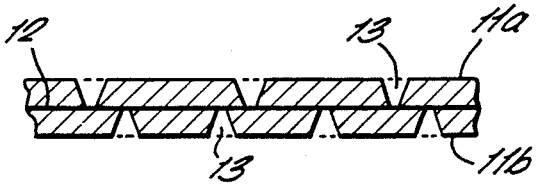
Figure 3C:
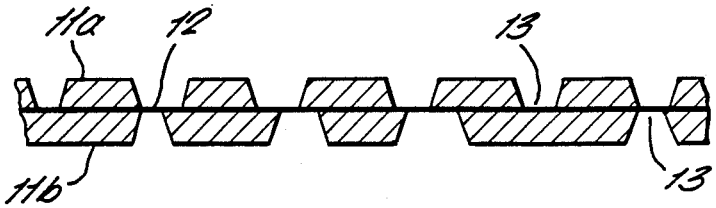

Windows 13 may be provided in the security paper 11 to expose sections of the security device 12. FIG. 2 shows windows 13 provided in an upper surface 11*a* of the security paper 11. Windows 13 may be provided in either or both surfaces 11*a* and 11*b*. FIGS. 3*a*, 3*b* and 3*c* show security paper 11 having windows 13 in both surfaces 11*a* and 11*b*. In FIG. 3*a* the windows are in registry whereas in FIG. 3*b* the FIGS. are out of registry. In FIG. 3*c* the windows are in partial registry.

Figure 14A:
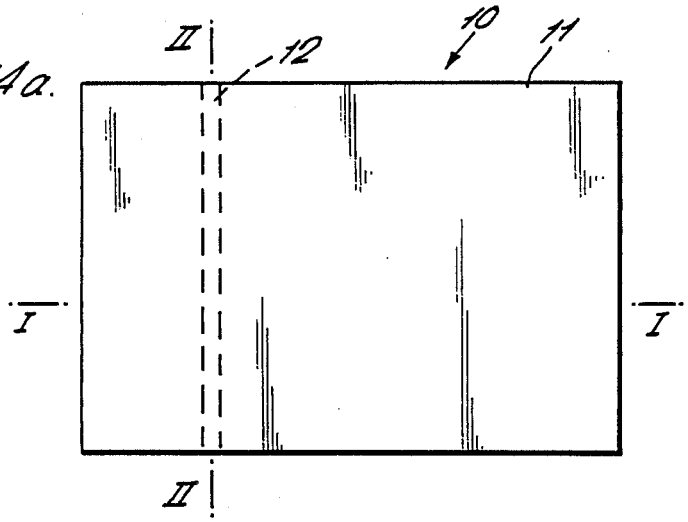
FIG. 14*a* is a plan view of the security paper of the invention wherein the security device is completely imbedded in the paper.
Figure 14B:
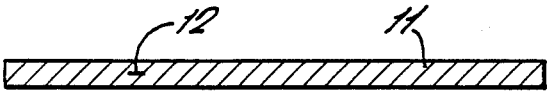
FIG. 14*b* is a cross sectional view of FIG. 14*a* along line I-13 I.
Figure 14C:
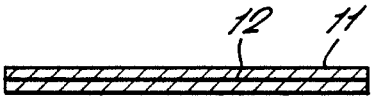
FIG. 14*c* is a cross sectional view of FIG. 14*a* along line II—II.

FIGS. 14*a*, 14*b* and 14*c* show another embodiment of the invention wherein the security device is completely embedded in the paper. Thus, the embodiment shown in FIGS. 14*a*, 14*b* and 14*c* does not have the windows 13 as shown in FIGS. 2, 3*a*, 3*b* and 3*c*.

Figure 4:
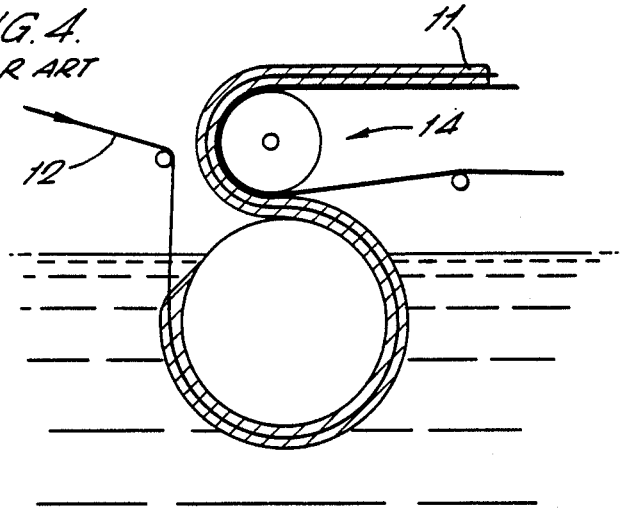
FIG. 4. PRIOR ART
FIG. 4 is a schematic section through a cylinder-style mold paper making machine according to prior art in normal operation inserting a security device in the form of a thread into security paper being made.

The security paper 11 is preferably formed on a conventional cylinder mold paper making machine 14 as shown in FIG. 4 which is labeled as prior art. It is also possible to form the security paper with the security device 12 imbedded therein by using a conventional Fourdrenier paper making machine as illustrated in FIG. 17. Fourdrenier machines and their method of use are well known. Typically, a strip 12 is inserted within the slice 25 of a Fourdrenier paper making machine 26 by inserting the strip within the fiber slurry 27 through a tube 28. The slurry 27 contains a mixture of fibers (e.g. cellulosic fibers 29) which are dewatered along the Fourdrenier wire 30 in the direction indicated by arrow 31 to form the paper 11 with the security device 12 imbedded therein.

Alternatively, the security paper 11 may be made by laminating at least 2 sheets of synthetic material with the security device being positioned between the two sheets. The resulting structure will be substantially the same as the structure shown in FIGS. 1, 2, 3*a*, 3*b*, and 3*c*.

As an additional security feature, the security paper 11 may have a watermark 15 incorporated in the paper during the paper making process. The security device 12 may be positioned within the watermark 15.

Figure 5A:
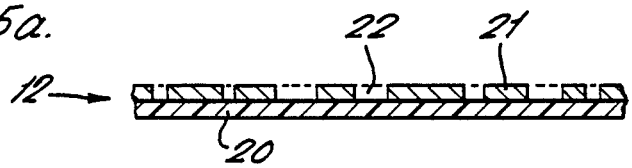
FIGS. 5*a*, 5*b* and 5*c* are enlarged portions of cross sections of alternative security devices for use in the security document of FIG. 1.
Figure 5B:
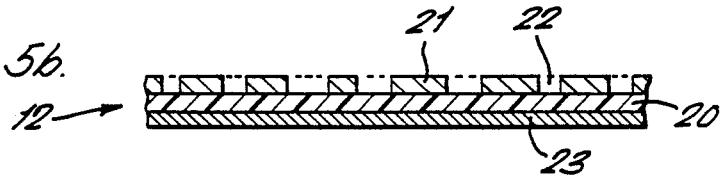
Figure 5C:
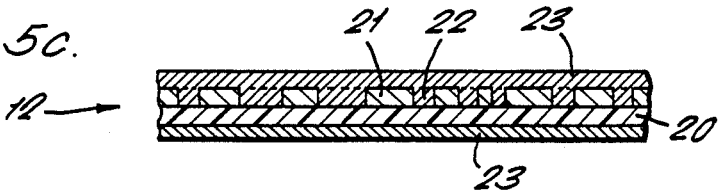

FIGS. 5*a*, 5*b* and 5*c* illustrate the composition of various security devices 12 which may be used in the invention. The security device 12 consists of a plastic substrate 20. A metallic layer 21 is vacuum deposited on the film 20 and demetallized in parts 22. A fluorescent coating 23 may be provided on either or both sides of the security device. As noted previously, the fluorescent coating may be substituted with a dye or a dichroic layer in all the embodiments of this invention. Also, as previously noted, when both sides are coated, both coatings need not be identical. For example one side may be coated with a dye and the other side may be coated with a fluorescent material.

Figure 15:
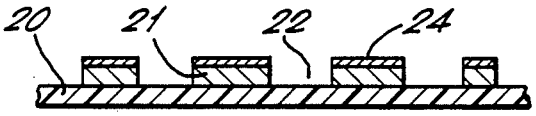
Figure 16:
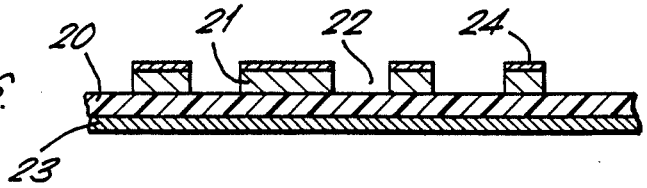

FIGS. 15, 16, 18, 19 and 20 also illustrate the composition of various security devices 12 which may be used in the present invention. FIGS. 15 and 16 illustrate an embodiment wherein a dyed or fluorescent coating 24 is present over the metal regions 21. FIG. 16, also includes an additional layer 23 which, as previously mentioned, may be a dyed or fluorescent or a dichroic layer.

FIG. 18 illustrates the embodiment wherein the dye or fluorescent coating 23 is on one side of the substrate 20 and the metal 21 is on the other side. FIG. 19 illustrates an alternative embodiment wherein the dye or fluorescent layer 23 is on the same side of substrate 20 as the metal 21. FIG. 20 illustrates another embodiment wherein layers 23 and 21 are on the same side of substrate 20 with the dye or fluorescent layer being located only in the demetallised regions 22.

Following is a description by way of example of various security papers in accordance with this invention:

Example 1

In one embodiment of the invention, transparent colourless plastic film which is partially metallised as described herein is slit to threads typically 1.2 mm width where the metal content forms 67% of the area of the thread. The thread is inserted into paper e.g. on a cylinder mould paper machine so that the total grammage of paper above and below the thread is significantly less than that of the grammage of paper adjacent to the thread, and in said paper the highlight areas, which are provided by the demetallised portion of the thread, when viewed in transmitted light are brighter than the paper adjacent to the thread.

Example 2

In another embodiment of the invention, transparent colourless plastic film which is partially metallised as described herein is uniformly coated on the metal-free side with a layer containing a dye or a fluorescent material. The film is then slit to form threads and inserted into paper. When the paper is viewed in the appropriate reflected light (visible, UV or IR), the coated side appears uniformly coloured whereas on the uncoated side only the highlight areas appear to be coloured. In transmitted light, the highlight areas only appear to be coloured regardless of which side is facing the observer.

Example 3

In another embodiment of the invention, transparent colourless plastic film is partially metallised as described herein, uniformly coated on one side with a layer containing a dye or fluorescent material and uniformly coated on the other side with another material of a different colour. The film is slit into threads and inserted into paper. In reflected light, each side will exhibit its own particular colour more or less uniformly although there may be some colour mix in the highlight areas. In transmitted light however, the highlight areas will be perceived as a third colour which will be a mix of the other two and markedly distinguishable from them.

Example 4

In another embodiment of the invention, transparent colourless plastic film is partially demetallised as described herein by means of a chemical resist and etch process whereby the resist which is positioned over the metal area where it is desired to retain the metal may be doped with a dye or fluorescent material. The film is then slit to form threads and inserted into paper. When the paper is viewed in the appropriate reflected light on the metallised side, the metal areas only appear coloured; the highlight areas are not coloured. When the paper is viewed on the unmetallised side of the thread, no colour is observed.

Example 5

In another embodiment of the invention, transparent colourless film is partially demetallised with a resist incorporating a dye or fluorescent material and the unmetallised side uniformly coated with a material containing a dye or fluorescent material of a different colour. The film is then slit to form threads and run into paper. When the paper is viewed in reflected light on the unmetallised side of the thread, a uniform colour is observed. When the paper is viewed in reflected light on the metallised side, the metal regions appear in one colour and the highlight regions in the second colour. When the paper is viewed in transmitted light, only the highlight regions are observed in the colour of the coating on the unmetallised side regardless of which side of the thread is facing the observer.

Example 6

Example 2 was modified by incorporating the dye or fluorescent material into the plastics material before metallisation. Similar visual effects were achieved to those of Example 2 when partially demetallised threads having the dye or fluorescent material in the plastics substrate were incorporated into paper.

Example 7

In another embodiment of the invention, transparent colourless plastic film which is partially demetallised as described herein is provided with a dichroic coating deposited on one or both sides. The colour perception of the metallised and highlight areas then changes according to viewing angle and/or according to the direction of illumination.

This embodiment is enhanced if used with paper with windows or apertures.

Example 8

In another embodiment of the invention, a transparent plastic film as described in any of the examples 1 to 7 is slit to form threads and inserted into paper such that at predetermined intervals along the thread it is exposed at the surface on one side of the paper sheet in accordance with the technique described in EP-B-O 059 056. The presence of the highlight regions of the partially metallised thread in regions of the paper where the thread is exposed or "windowed" at the surface of the paper greatly increases the difficulty of simulating the appearance of these latter regions and enhances the overall security of the document. In transmitted light, the predominantly metal strip is very clearly seen to be continuous but when the front i.e. windowed surface of the paper is viewed in reflected light there is a very sharp contrast between the highly reflective exposed regions of metallised thread and the same metallised regions embedded in a fibre bridge between two windows where the thread is virtually invisible. The full benefits of the incorporation of coloured or fluorescing agents as described in Examples 2 to 6 are most apparent when security threads are used in windowed form, as more fully described in Example 12.

The benefits of using a partially metallised thread in the afore-mentioned arrangement is of great importance with respect to protection against counterfeits. When banknotes or other documents containing a security thread manufactured according to this example are reproduced on a colour photocopier or laser scanner machine, the metallised regions of the security thread in the exposed areas are reproduced as black or dark regions and the highlight regions are reproduced as white or light regions. In order to simulate the appearance of the genuine printed document the counterfeiter must then provide by some means a "metallic" appearance in the appropriate regions leaving the highlight regions clear. This is a complicated and tedious operation and more difficult than simulating the appearance of a wholly metallised security thread. Thus paper produced according to this example has enhanced security against counterfeits produced using colour photocopier or laser scanning machines.

Example 9

In another embodiment of the invention, a transparent plastic film according to any of the examples 1 to 7 is slit to form threads and inserted between two layers of fibre formed independently on a paper machine prior to bringing these two layers together. A watermarking process is used to produce regions in one of the layers where the fibre thickness is locally reduced to a very thin layer or to produce no fibres at all, i.e. a hole. Alternatively a sequence of holes is produced in one of the layers by a water jet or some other means. The thread is arranged to run across these holes or thin areas such that the thread is virtually or completely exposed on one surface of the final paper sheet in predetermined locations.

Example 10

In another embodiment, a process similar to that described in example 9 is used except that a sequence of holes or regions of thin fibre coverage is produced in two layers of paper prior to bringing them together such that the thread is exposed in a predetermined manner on both sides of the final paper sheet.

Example 11

In another embodiment, a process similar to that described in example 10 is used except that the holes or regions of thin fibre coverage in two layers are brought together at least in partial register with each other and the thread such that the thread is exposed simultaneously on both sides of the sheet in predetermined locations, that is the thread runs through one or more apertures.

Example 12

In another embodiment of the invention, transparent colourless film is partially demetallised with a resist incorporating a dye or fluorescent material and the unmetallised side uniformly coated with a material containing a dye or fluorescent material of a different colour. The film is then slit to form threads and run into paper in accordance with the technique described in EP-B-0059056 such that regions of the thread are exposed on one surface of the sheet.

Where the metallised side of the thread is exposed in the windows of the paper there is a very strong contrast between the metallised region, coloured due to the colouring agent in the resist, and the highlight regions, coloured due to the colouring agent in the uniform coating, when the paper is viewed in the appropriate reflected light on that side of the sheet; the contrast is more dramatic than for those regions between the windows where the thread is covered by fibre on both sides. In transmitted light only the highlight regions are observed, which are coloured due to the colouring agent in the uniform coating, and are seen to be brighter in those window regions where the thread is exposed on one side than between the windows where the thread is covered with fibre on both sides.

Where the non-metallised side of the thread is exposed in the windows of the paper and the paper is viewed on that side in the appropriate reflected light, the thread has a nearly uniform colour which is brighter in the window regions than between windows where the thread is covered with fibre. In transmitted light, again only the highlight regions are coloured due to the colouring agent in the uniform coating and are seen to be brighter in the window regions than between windows.

As an alternative to the use of a uniform coating on the non-metallised side of the thread, a dye or fluorescing agent may be incorporated into the plastic film to achieve the same effects.

These pronounced effects draw attention to the presence of the highlight regions in the partially metallised strip and greatly enhance the difficulty of simulating a metallised security thread in window threaded paper. The security threads shown in FIGS. 6–13 are presented in an enlarged form and in use their width typically is 1.2 mm. The threads are all formed by demetallising vacuum deposited aluminium which is supported on a polyester film. The aluminium was removed by using a resist and etch technique.

The metal contents of the threads shown in the drawings are set out in the following table.

TABLE

Figure 6:
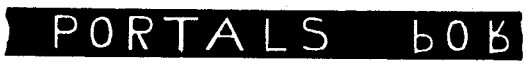
FIGS. 6–13 are plan view of various security devices for use in the security document of FIG. 1.
Figure 7:
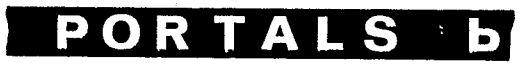
Figure 8:
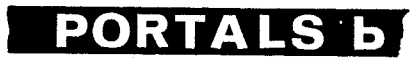
Figure 9:
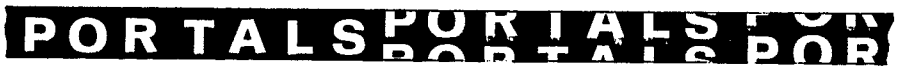
Figure 10:
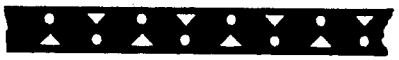
Figure 11:
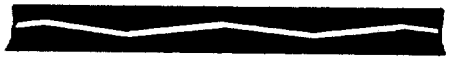
Figure 12:
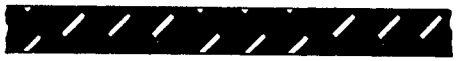
Figure 13:
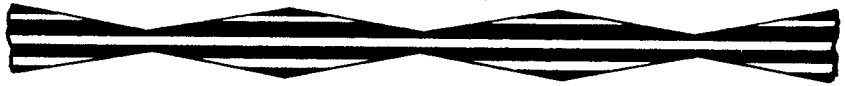

| | |
|---|---|
| FIG. 6 | 84% |
| FIG. 7 | 67% |
| FIG. 8 | 55% |
| FIG. 9 | 63% |
| FIG. 10 | 84% |
| FIG. 11 | 79% |
| FIG. 12 | 89% |
| FIG. 13 | 61% |

Bank notes formed from threads as illustrated in FIGS. 6 to 13 of the drawings provided excellent security and provide (when inserted into bank note paper) a public security feature as the threads were eminently "readable" by the public viewing with transmitted light without the aid of a lens or other viewing accessory. The threads were almost invisible when the notes were viewed with reflected light. FIG. 13 describes thread with a geometric profile. This may be formed by a mechanical stamping/cutting machine or by a laser, e.g. excimer or carbon dioxide laser. As an alternative to the cutting of demetallised film, the film could first be cut to shape and then demetallised by excimer laser acting on slit thread (This technique may also be used with parallel sided thread).The pattern, design, indicia or the like of the security devices can be perceived by the members of public without the use of a special viewing device such as a magnifying glass and a document incorporating such a device can accordingly be recognised as a genuine document.

It will be appreciated the threads within bank notes according to the present invention are to all intents and purposes identical and hence the bank notes will be identical for a given denomination or issue. This will be subject to normal manufacturing tolerances and for e.g. a legend such as "PORTALS" it must be understood that in the absence of machine direction registration technology, any part of the message could be present with respect to the top or bottom of the note; this is entirely consistent with the practice of microprinted threads which are in common usage.

It is to be understood that the terms 'security paper', 'security document' and 'banknote' in this specification include such items which are manufactured wholly from natural fibres (e.g. cotton or wood), partially from natural and partially from synthetic fibres (e.g. nylon, polyvinyl alcohol, viscose), and wholly from synthetic materials (e.g. spun-bonded polyolefin, polypropylene).

Security documents which comprise partially natural and partially synthetic fibres may be produced from paper made by preparing an aqueous mixed dispersion of such fibres for use on conventional papermaking machines, e.g. a cylinder mould machine or a fourdrinier machine, and the security strip or other security device is included according to known procedures. Alternatively, the paper may be produced on a multiple-ply forming machine whereby one or more plies is formed wholly from natural or synthetic fibres; the security device is embedded between the plies at the point at which they are joined together. A further alternative is to laminate using an appropriate adhesive a dry sheet formed wholly or partially from one type of fibre (e.g. synthetic) to another dry sheet formed wholly from the other type (e.g. natural) with the security device being embedded at the point of lamination.

Security documents in accordance with this invention which comprise wholly synthetic materials may be formed from synthetic fibres in a manner analogous to conventional papermaking processes. Alternatively, for example, a sheet or web of a synthetic material, e.g. polypropylene, may be laminated using an appropriate adhesive to another sheet or web of the same or different synthetic material and the security device, e.g. a strip, be embedded within the final laminate by incorporation at the point of lamination. Further suitable processes will be apparent to those skilled in the art.

Preferably the partially metallised films referred to in this specification are created from vacuum deposition of aluminium or another metal onto a plastics film, for example in accordance with one of the techniques described herein. However, it is also possible to use a plastics substrate coated or printed with special metallic inks, e.g. "Metasheen" ink from Johnson & Bloy Ltd, Crawley, Sussex, England, presently available under the ink code SLS 34. Metasheen ink results in a surface of high specular reflectance and which is also conductive. A dye or fluorescent material may be incorporated into the ink such that when the security strip is illuminated by the appropriate stimulating radiation, the metallised regions are observed as coloured regions in perfect register with printed metallised regions produced with Metasheen ink. It is to be understood that other inks which give a metallic appearance and provide a conductive layer may be used in accordance with this invention.

We claim:

1. Security paper comprising opposed surfaces for the provision of printing to identify a document formed from the security paper, a security device positioned between the two surfaces of the security paper as a public security feature such that at least a portion of the said security device is totally imbedded within the security paper, said security device being of not more than 5 mm width, and comprising a flexible, water-impermeable substrate with a layer of metal on at least one side of the substrate, there being present on one side of the device a continuous metal path along its length, wherein said device has metal-free portions which transmit light of between 10% and 50% of the area of the device, said metal-free portions along the length of the device providing a repeating means of identification with at least some of the metal-free portions across the transverse direction of the device being wholly surrounded by metal.

2. The security paper of claim 1 wherein the security device is a strip or thread having a width of 1 to 3 mm.

3. The security paper of claim 1 wherein the metal free portion provides letters of an alphabet.

4. The security paper of claim 1 wherein the area of the metal-free portions is from 10% to 45% of the area of the security device.

5. The security paper of claim 4 wherein the area of the metal-free portions is from 15% to 40%.

6. The security paper of claim 1 which further comprises a watermark and said security device is positioned within the watermark.

7. The security paper of claim 1 wherein the security device is exposed at a plurality of locations on at least one of the opposing surfaces of said paper.

8. The security paper of claim 7 wherein the security device is exposed at a plurality of locations on each opposing surface of said paper.

9. The security paper of claim 8 wherein the exposed locations on the opposing surfaces are in registry with each other.

10. The security paper of claim 8 wherein the exposed locations on the opposing surfaces are in partial registry with each other.

11. The security paper of claim 1, wherein a dye is present on at least one side of the security device.

12. The security paper of claim 11, wherein the dye is present on both sides of the security device, said dye being the same on both sides.

13. The security paper of claim 11 wherein the dye is present on both sides of the security device; said dye being different on one side to that on the other side.

14. The security paper of claim 1, wherein the security device comprises a plastics substrate with the metal on one side thereof, and a dye is present in the plastics substrate.

15. The security paper of claim 1 wherein a fluorescent material is present on at least one side of the security device.

16. The security paper of claim 15 wherein the fluorescent material is present on both sides of the security device; said fluorescent material being the same on both sides.

17. The security paper of claim 15 wherein the fluorescent material is present on both sides of the security device and said fluorescent material being different on one side to that on the other side.

18. The security paper of claim 1, wherein the security device comprises a plastics substrate with the metal on one side thereof, and a dye is present in a coating on the surface of the metal.

19. The security paper of claim 1 wherein the security device comprises a plastic substrate with the metal on one side of said substrate and a dye on the surface of the substrate.

20. The security paper of claim 19 wherein the dye is on one side of the plastic substrate and the metal coating is on the other side of the plastic substrate.

21. The security device of claim 1 wherein the security device comprises a plastic substrate with the metal on one side thereof and fluorescent material is present in the plastic substrate.

22. The security paper of claim 1 wherein the security device comprises a plastic substrate with the metal on one side of the substrate and a fluorescent material present on the surface of said substrate.

23. The security paper of claim 22 wherein the fluorescent material is on one side of the substrate and the metal coating is on the other side of the substrate.

24. The security paper of claim 1 wherein the security device comprises a plastic substrate with the metal on one side of the substrate and a fluorescent material is present in a coating on the surface of the metal.

25. The security paper of claim 1, wherein the security device comprises a plastics substrate with the metal on one side thereof and a dichroic layer is present on at least one side of the device.

26. The security paper of claim 1 wherein the paper is made from fibers selected from the group consisting of synthetic fibers, natural fibers and mixtures thereof.

27. The security paper of claim 1 wherein the paper comprises two laminated sheets with the security device positioned between the two sheets.

28. A security document which comprises the security paper of claim 18 with printing on a surface of said paper.

* * * * *